US007854156B2

(12) United States Patent
Tsuda et al.

(10) Patent No.: US 7,854,156 B2
(45) Date of Patent: Dec. 21, 2010

(54) CLOSING DEVICE AND CLOSING METHOD

(75) Inventors: Naomasa Tsuda, Tokyo (JP); Keisuke Mishima, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 662 days.

(21) Appl. No.: 11/826,330

(22) Filed: Jul. 13, 2007

(65) Prior Publication Data

US 2008/0034826 A1 Feb. 14, 2008

(30) Foreign Application Priority Data

Aug. 9, 2006 (JP) ..... 2006-216683

(51) Int. Cl.
*B21D 41/00* (2006.01)
*B21D 5/00* (2006.01)

(52) U.S. Cl. ..... 72/82; 72/96; 72/370.12; 72/453.01

(58) Field of Classification Search ..... 72/370.12, 72/67–126, 453.01, 453.02, 453.14, 453.18
See application file for complete search history.

(56) References Cited

U.S. PATENT DOCUMENTS 6,672,123 B2 * 1/2004 Sczesny et al. ..... 72/115

FOREIGN PATENT DOCUMENTS

| | | | |
|---|---|---|---|
| DE | 197 14 753 A 1 | | 10/1998 |
| DE | 102 23 675 C 1 | | 5/2003 |
| EP | 1 409 177 B1 | | 12/2005 |
| JP | 2003-200241 | | 7/2003 |
| JP | 2005-342725 | | 12/2005 |
| JP | 2005342725 A | * | 12/2005 |

* cited by examiner

*Primary Examiner*—Dana Ross
*Assistant Examiner*—Mohammad Yusuf
(74) *Attorney, Agent, or Firm*—Rabin & Berdo, PC

(57) ABSTRACT

A closing device 100 which presses a die 2 against a rotating pipe body 1 such that an open end portion of the pipe body 1 is plastically closed by the die 2 includes a cored bar 3 inserted into the pipe body 1 to close the open end portion of the pipe body 1 on the opposite side of the die 2, and a reactive force applying mechanism 43, 60 which allows the cored bar 3 to retreat and applies a reactive force to the retreating cored bar 3 when the cored bar 3 receives a predetermined load or more during processing of the pipe body 1 by the die 2.

4 Claims, 4 Drawing Sheets

CLOSING DEVICE AND CLOSING METHOD

TECHNICAL FIELD OF THE INVENTION

This invention relates to a closing device and a closing method.

DESCRIPTION OF RELATED ART

In a known method for closing an open end portion of a metal pipe, the pipe is heated and rotated, and a die is moved toward the pipe and pressed against the open end portion of the pipe. As a result, the pipe open end portion is closed into a closed-end shape through plastic deformation (see JP2005-342725).

During the closing processing, a cored bar is inserted into the pipe and used to shape the pipe open end portion closed on the opposite side of the die.

The cored bar is disposed in a state of restricted axial movement so as to contact the rear surface of the plastically deformed pipe when the die reaches a final processing position.

SUMMARY OF THE INVENTION

Hence, in conventional closing processing, the cored bar is brought into contact with the rear surface of the plastically deformed pipe at the final pipe processing stage, and during the processing, shaping is performed by the die alone.

Therefore, during shaping performed by the die alone, before the cored bar contacts the rear surface of the pipe, deformation of the pipe may be unstable. In this case, the thickness of the closed-end portion of the processed pipe may become uneven and deformation tracks may be left on the front surface of the processed pipe, leading to decreased yield.

This invention has been designed in consideration of these problems, and it is an object thereof to provide a closing device and a closing method with which the quality of a finished article can be stabilized.

In order to achieve above object, this invention provides a closing device which presses a die against a rotating pipe body such that an open end portion of the pipe body is plastically closed by the die. The closing device comprises a cored bar inserted into the pipe body to close the open end portion of the pipe body on an opposite side to the die, and a reactive force applying mechanism which allows the cored bar to retreat and applies a reactive force to the retreating cored bar when the cored bar receives a predetermined load or more during processing of the pipe body by the die.

According to this invention, the cored bar is capable of retreating upon reception of a predetermined load or more, and therefore the initial position of the cored bar at the start of the processing can be set near the open end portion of the pipe body. Thus, the cored bar contacts the rear surface of the pipe from the initial stage of the processing. Moreover, the cored bar receives a reactive force when it retreats upon reception of a load, and therefore the pipe open end portion receives a load between the die and the cored bar during the processing. Since the cored bar contacts the pipe from the initial stage of the processing and the pipe open end receives a load between the die and the cored bar at this time, deformation of the pipe is stabilized, leading to stability in the quality of the finished article.

DETAILED DESCRIPTION OF THE INVENTION

Figure 1:
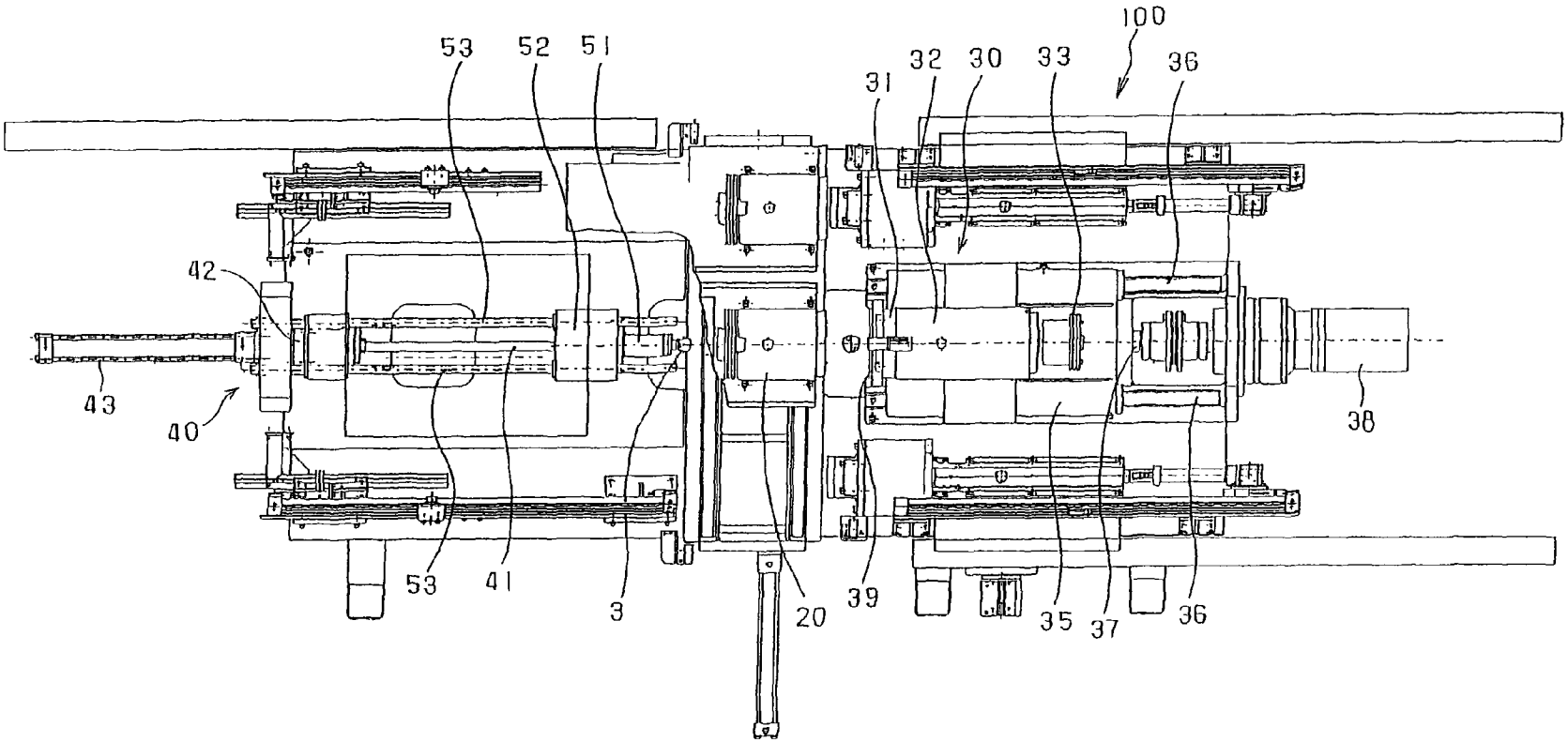
FIG. 1 is a plan view showing a closing device 100 according to an embodiment of this invention.
Figure 2:
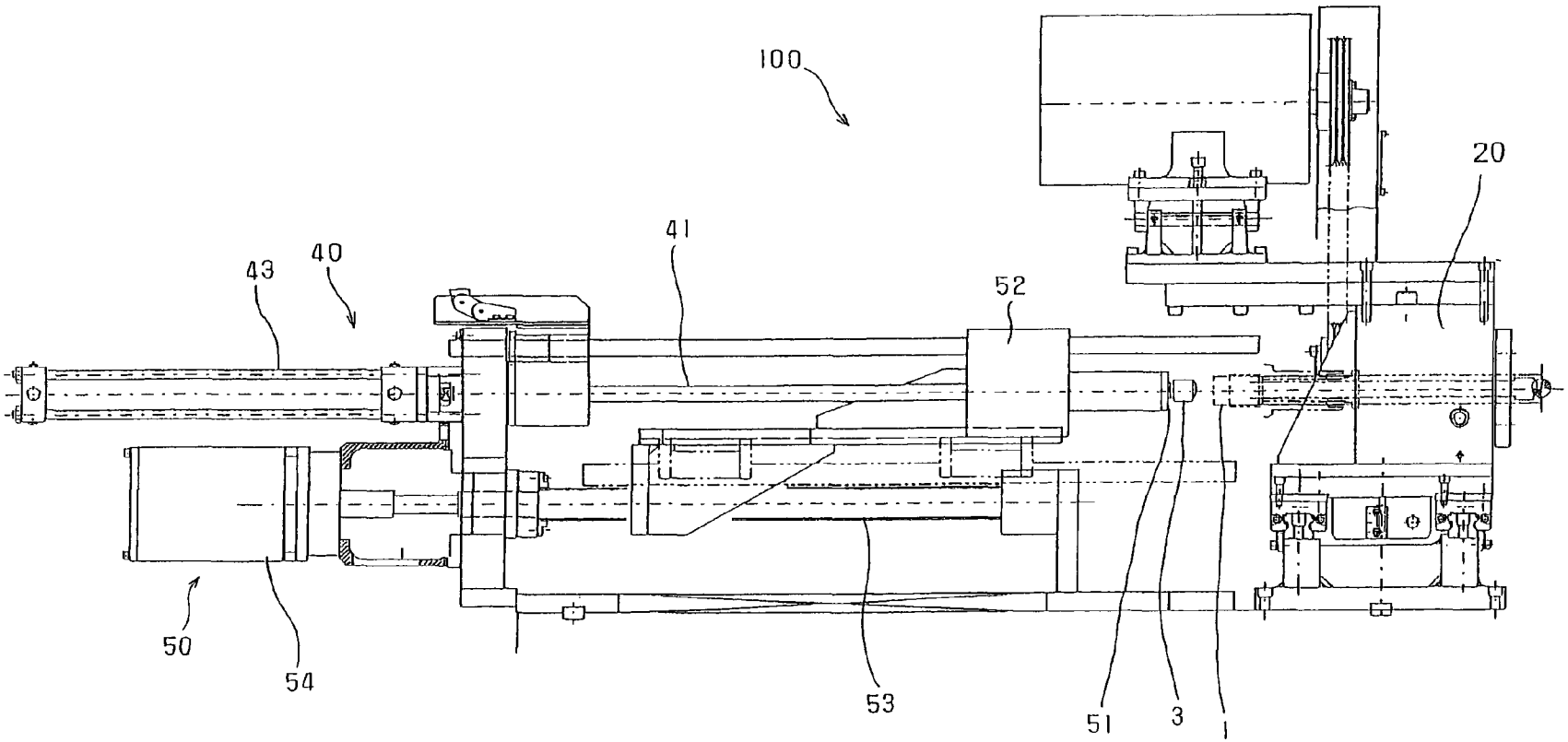
FIG. 2 is a partial side view of the closing device 100.

An embodiment of this invention will be described below with reference to the drawings.

Referring to FIGS. 1 to 4, a closing device 100 according to an embodiment of this invention will be described.

First, the overall constitution of the closing device 100 will be described.

The closing device 100 is a device for closing an open end portion of a pipe 1 serving as a metal pipe body to shape the pipe 1 into a closed-end shape. While the pipe 1 is heated and rotated, a die 2 is pressed against the open end portion of the pipe 1 to subject the pipe 1 to plastic deformation, and as a result, the pipe open end portion is closed.

An outer peripheral surface of the pipe 1 is gripped by a chuck spindle 20 disposed near a central portion of the closing device 100. The chuck spindle 20 is rotated (spun) about the axial center of the gripped pipe 1.

As shown in FIG. 4, the die 2 has a die cavity 2*a* corresponding to the shape of the closed-end portion of the closed pipe 1, and is disposed facing the pipe 1.

The die 2 can be rotated (spun) and moved in the axial direction of the pipe 1 by a die driving mechanism 30.

The die driving mechanism 30 comprises a die support base 31 which supports a shaft (not shown) rotatably via a bearing, the die 2 being attached to an end portion of the shaft, a motor 32 which rotates the die 2 via the shaft, a power transmission mechanism 33 which transmits the rotation of the motor 32 to the shaft, and a one-way clutch (not shown) which inputs torque into the shaft from the power transmission mechanism 33 while blocking torque input into the power transmission mechanism 33 from the shaft.

By means of these constitutions of the die driving mechanism 30, the die 2 rotates when the motor 32 is driven, and when the die 2 is pressed against the pipe 1 while the pipe 1 rotates at a higher speed than the die 2, the die 2 rotates in subordination to the pipe 1 through the action of the one-way clutch.

The die driving mechanism 30 further comprises a sliding table 35 carrying the die support base 31, a pair of guide rails 36 which extend in the axial direction of the pipe 1 and guide the sliding table 35, a ball screw 37 screwed to the sliding table 35, and a motor 38 having an output shaft that is connected to the ball screw 37.

By means of these constitutions of the die driving mechanism 30, when the motor 38 is driven, the sliding table 35 carrying the die support base 31 moves along the guide rails 36, and thus the die 2 can be moved in an approaching or retreating direction relative to the pipe 1. Hence, by driving the motor 38, the die 2 can be pressed against the open end portion of the pipe 1.

A high-frequency induction heating coil 39 capable of heating the outer periphery of the pipe 1 is attached to the tip end of the die support base 31. Hence, when the die 2 is moved to shape the open end portion of the pipe 1 closed, the pipe 1 is inserted in the high-frequency induction heating coil 39, and therefore the pipe 1 is processed while being heated.

A cored bar 3 which is capable of moving through the hollow portion of the pipe 1 to shape the open end portion of the pipe 1 closed on the opposite side of the die 2 is disposed at the rear of the chuck spindle 20. The tip end of the cored bar 3 is formed in a spherical shape, and the rear surface shape of the closed-end portion formed on the pipe 1 is defined by this tip end.

The cored bar 3 can be rotated (spun) and moved in the axial direction of the pipe 1 by a cored bar driving mechanism 40.

The cored bar driving mechanism 40 comprises a rod 41 supporting the cored bar 3 and extending on the same axis as the pipe 1, a support 42 which supports a base end side of the rod 41 rotatably via a bearing, and a hydraulic cylinder 43 which moves the support 42 in the axial direction of the pipe 1.

By operating the hydraulic cylinder 43 to expand, the cored bar 3 on the tip end of the rod 41 is inserted into the hollow portion of the pipe 1. The operation of the hydraulic cylinder 43 will be described in detail later. When the cored bar 3 contacts the rotating pipe 1 during the closing processing, the cored bar 3 rotates in subordination to the pipe 1.

A stopper 51 which contacts the base end of the pipe 1 to restrict movement of the pipe 1 during processing of the pipe 1 is disposed at the rear of the chuck spindle 20.

The stopper 51 has a cylindrical shape and is disposed coaxially with the rod 41 that supports the cored bar 3 such that the rod 41 penetrates a hollow portion of the stopper 51. The stopper 51 can be moved in the axial direction of the pipe 1 by a stopper driving mechanism 50.

The stopper driving mechanism 50 comprises a sliding table 52 that supports the stopper 51 rotatably via a bearing, a pair of guide rails 53 extending in the axial direction of the pipe 1 for guiding the sliding table 52, and a motor 54 that moves the sliding table 52 along the guide rails 53.

By means of the stopper driving mechanism 50, the stopper 51 is disposed in a standby position removed from the pipe 1 or a processing position in contact with the base end of the pipe 1 so as to support the pipe 1.

Figure 3:
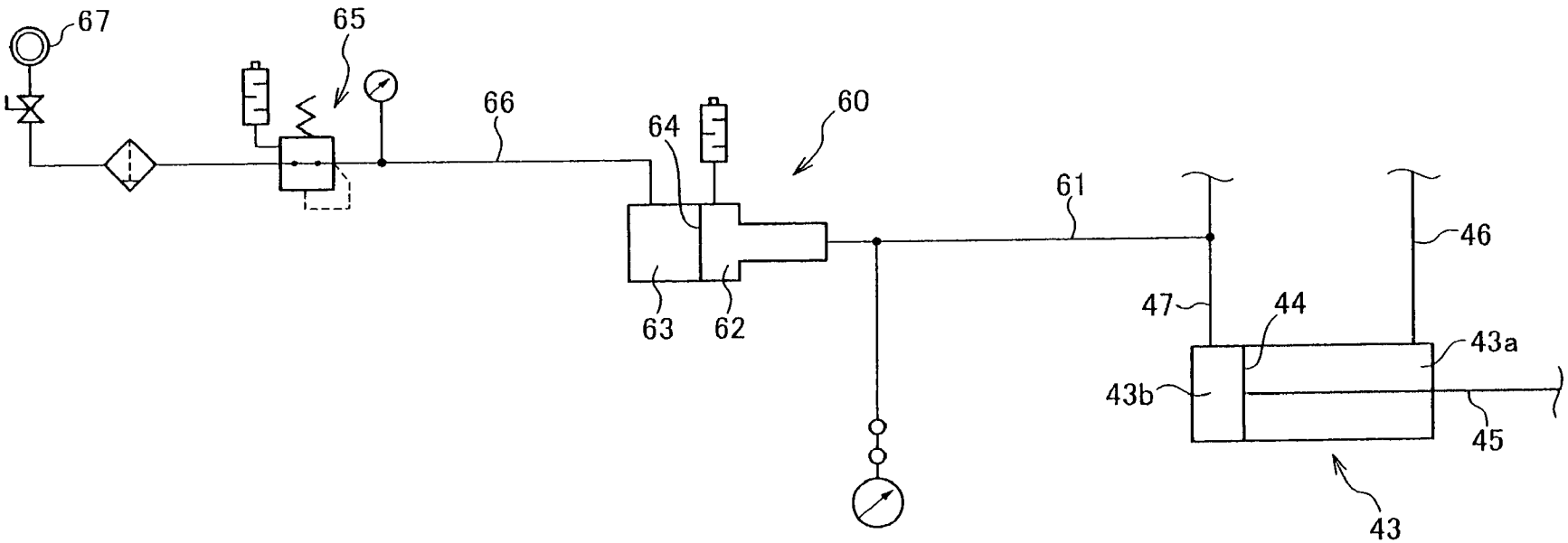
FIG. 3 is a hydraulic circuit diagram of a hydraulic unit in a cored bar driving mechanism of the closing device 100.

Next, referring to FIG. 3, a hydraulic unit including the hydraulic cylinder 43 of the cored bar driving mechanism 40 will be described.

The hydraulic cylinder 43 is divided into a rod side oil chamber 43*a* and a bottom side oil chamber 43*b* by a piston 44 disposed so as to be free to slide along the inner periphery thereof, and each oil chamber is filled with working fluid. The piston 44 is connected to the support 42 via a rod 45.

Flow passages 46, 47 through which the working fluid flows are provided respectively in the rod side oil chamber 43*a* and bottom side oil chamber 43*b* of the hydraulic cylinder 43, and working fluid from a pump (not shown) is supplied to the hydraulic cylinder 43 through the flow passages 46, 47.

An electromagnetic switch valve (not shown) is connected to the flow passages 46, 47, and by switching the position of the switch valve, working fluid is supplied to, discharged from, and shut off from the hydraulic cylinder 43. By operating the hydraulic cylinder 43 to expand and contract through an operation of the switch valve, the cored bar 3 supported on the rod 41 moves, and by setting the switch valve in a shut-off position, the cored bar 3 is fixed in the processing position.

A hydro-converter 60 serving as a second cylinder for converting air pressure into oil pressure is connected to the bottom side oil chamber 43*b* of the hydraulic cylinder 43.

The hydro-converter 60 is divided into an oil chamber 62 which is filled with working fluid and communicates with the bottom side oil chamber 43*b* via a flow passage 61, and an air chamber 63 into which air is sealed. The oil chamber 62 and air chamber 63 are partitioned by a free piston 64. The flow passage 61 bifurcates from the flow passage 47 connecting the switch valve to the bottom side oil chamber 43*b*.

Compressed air is supplied to the air chamber 63 of the hydro-converter 60 from an air pressure supply source 67 through an air supply pipe 66.

A pressure regulator 65 which reduces the pressure of the compressed air supplied from the air pressure supply source 67 to maintain the pressure of the air system at a predetermined pressure, and discharges the compressed air to maintain the predetermined pressure when the pressure of the air chamber 63 rises to or above the predetermined pressure, is provided between the air chamber 63 and the air pressure supply source 67.

Hence, the pressure regulator 65 has a function for reducing the pressure to a set pressure and a relief function for allowing air pressure to escape in order to maintain the set pressure.

Next, referring to FIGS. 3 and 4A-4C, each step of a closing method employing the closing device 100 will be described in sequence. The operations of each member described below are controlled automatically by a controller (not shown) installed in the closing device 100.

First, as preparation before the processing begins, the chuck spindle 20 and die driving mechanism 30 are driven to rotate the pipe 1 and the die 2.

Further, the stopper driving mechanism 50 is driven to dispose the stopper 51 in the processing position, or in other words a position for restricting movement of the pipe 1 by supporting the base end of the pipe 1.

Figure 4A:
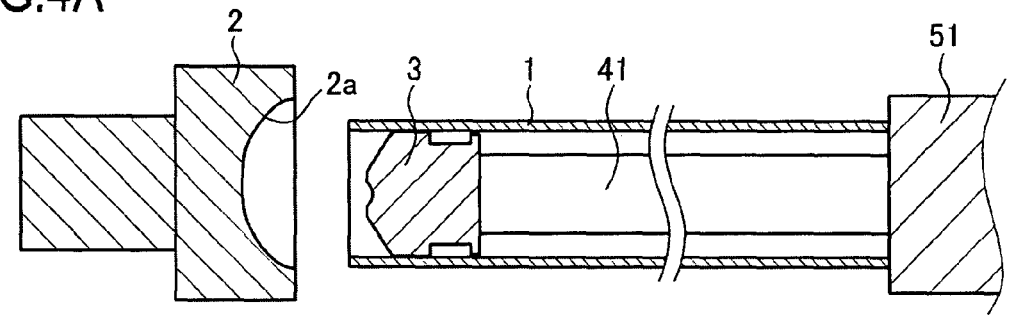
FIGS. 4A to 4C are pattern diagrams showing a closing procedure performed by the closing device 100.

Further, the hydraulic cylinder 43 is expanded to a maximum extent and the switch valve of the hydraulic cylinder 43 is set in the shut-off position. As a result, the cored bar 3 is positioned near the open end portion of the pipe 1, as shown in FIG. 4A. The set pressure of the pressure regulator 65 is set at the same pressure as the oil pressure in the bottom side oil chamber 43*b* when the hydraulic cylinder 43 is expanded to the maximum extent.

Figure 4B:
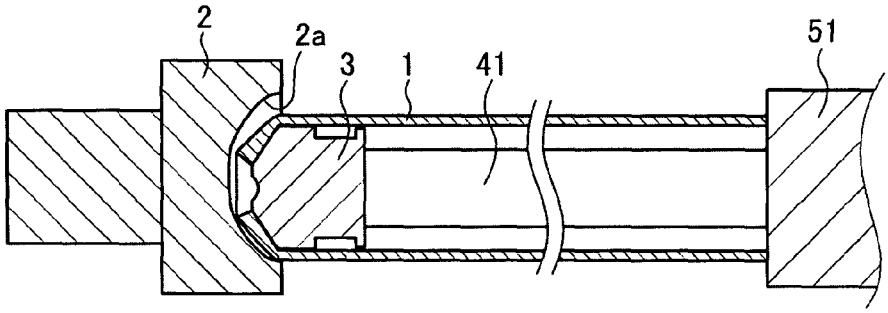

Once this pre-processing preparation is complete, processing begins. As shown in FIG. 4B, by driving the die driving mechanism 30, the die 2 is caused to advance toward the pipe 1 until the die 2 is pressed against the open end portion of the pipe 1.

Hence, the open end portion of the pipe 1 is subjected to plastic deformation along the die cavity shape of the die 2, and the rear surface of the plastically deformed pipe 1 contacts the cored bar 3. Thus, the cored bar 3 is positioned near the open end portion of the pipe 1, and therefore contacts the pipe 1 from the initial stage of the processing.

The processing load of the die 2 is greater than a predetermined load determined from the oil pressure in the bottom side oil chamber 43*b* of the hydraulic cylinder 43 and the pressure-receiving surface area of the piston 44, and therefore, by moving the die 2 toward the pipe 1, the cored bar 3 is pushed by the die 2 so as to receive the load. As a result, the piston 44 in the hydraulic cylinder 43 is pushed, and the oil pressure in the bottom side oil chamber 43*b* rises.

The switch valve connected to the flow passage 47 is set in the shut-off position, and therefore, as a result of the increase in the oil pressure in the bottom side oil chamber 43*b*, the oil pressure in the oil chamber 62 of the hydro-converter 60 also rises. Thus, the air chamber 63 is compressed via the free piston 64.

Figure 4C:
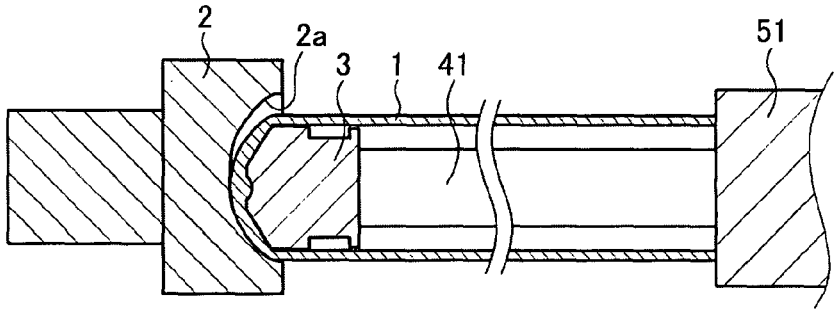

When the air chamber 63 is compressed in this manner, the piston 44 is capable of sliding along the inner periphery of the hydraulic cylinder 43, and therefore the cored bar 3 receives the load produced by the die 2 and retreats, as shown in FIG. 4C.

As the cored bar 3 retreats, the air chamber 63 is compressed, and hence the air in the air chamber 63 generates a repulsive force (air spring force). As a result, a reactive force is applied to the cored bar 3 as the cored bar 3 retreats. Thus, the air chamber 63 of the hydro-converter 60 enables the cored bar 3 to retreat when the cored bar 3 receives the load, and also acts to apply a reactive force to the retreating cored bar 3. This corresponds to a reactive force applying mechanism.

The reactive force received by the cored bar 3 is applied to the pipe 1, and therefore the open end portion of the pipe 1 receives a load between the die 2 and the cored bar 3 during the processing.

When the cored bar 3 receives the load such that the air chamber 63 of the hydro-converter 60 is compressed, leading to an increase in the internal pressure of the air chamber 63, the compressed air of the air system is discharged by the pressure regulator 65, and therefore the internal pressure of the air chamber 63 is maintained at the set pressure of the pressure regulator 65. In other words, the reactive force applied to the cored bar 3 is kept constant. This corresponds to a reactive force maintaining mechanism.

Accordingly, the load received by the rear surface of the pipe 1 from the cored bar 3 is also kept constant during the processing, and as a result, the pipe 1 exhibits a stable deformation characteristic.

As described above, the pipe 1 is processed between the die 2 and the cored bar 3 such that the open end portion of the pipe 1 is closed to form a closed-end portion.

According to the embodiment described above, the following effects are achieved.

When the cored bar 3 receives a predetermined load or more from the die 2 during processing of the pipe 1, the air chamber 63 of the hydro-converter 60 is compressed, enabling the cored bar 3 to retreat. Hence, in comparison with a conventional processing method in which axial movement of the cored bar 3 is restricted, the load on the bearing supporting the cored bar 3 is lightened, and the life of the bearing is increased.

Furthermore, since the cored bar 3 is capable of retreating, the initial position of the cored bar 3 at the start of the processing can be set near the open end portion of the pipe 1. In so doing, the cored bar 3 contacts the rear surface of the pipe 1 from the initial stage of the processing, and therefore, in comparison with a conventional processing method in which the cored bar 3 only comes into contact with the rear surface of the pipe 1 at the final stage of the processing, deformation of the pipe 1 is stabilized.

Further, the cored bar 3 contacts and receives a load from the rear surface of the pipe 1 from the initial stage of the processing, and therefore the load on the stopper 51 supporting the pipe 1 can be lightened. As a result, the load on the bearing supporting the stopper 51 is lightened, and the life of the bearing is increased.

Further, when the cored bar 3 receives the load and retreats, the cored bar 3 receives a reactive force generated when the air chamber 63 of the hydro-converter 60 is compressed, and therefore the open end portion of the pipe 1 receives a load between the die 2 and the cored bar 3 during the processing. As a result, deformation of the pipe 1 is stabilized.

Moreover, the load received by the rear surface of the pipe 1 from the cored bar 3 is kept constant during the processing, and therefore unevenness in the thickness of the closed-end portion of the pipe 1 is prevented.

According to the embodiment described above, deformation of the pipe 1 during the processing is stable, and therefore the quality of the pipe 1 is improved.

This invention may be applied to a device for manufacturing a tube of a shock absorber installed in a vehicle, for example.

This invention is not limited to the embodiment described above, and may naturally be subjected to various modifications within the technical scope thereof.

What is claimed is:

1. A closing device which presses a die against a rotating pipe body such that an open end portion of the pipe body is plastically closed by the die, comprising:

a cored bar inserted into the pipe body to close the open end portion of the pipe body on an opposite side to the die; and a reactive force applying mechanism which allows the cored bar to retreat and applies a reactive force to the retreating cored bar when the cored bar receives a predetermined load or more during processing of the pipe body by the die, the reactive force applying mechanism comprising:

a hydraulic cylinder divided into a rod side oil chamber and a bottom side oil chamber by a piston to which a rod supporting the cored bar is connected, which performs an expanding/contracting operation by supplying and discharging a working fluid to and from the two oil chambers; and a second cylinder divided into an air chamber sealed with air, and an oil chamber filled with a working fluid and connected to the bottom side oil chamber of the hydraulic cylinder via a flow passage, wherein the supply and discharge of the working fluid to and from the bottom side oil chamber of the hydraulic cylinder is shut off during processing of the pipe body, and when the cored bar receives a load during processing of the pipe body by the die, the air chamber of the second cylinder is compressed via the bottom side oil chamber and the oil chamber of the second cylinder, whereby the cored bar retreats and receives the reactive force.

2. The closing device according to claim 1, further comprising a reactive force maintaining mechanism which keeps the reactive force applied to the cored bar by the reactive force applying mechanism constant.

3. The closing device according to claim 2, wherein the reactive force maintaining mechanism keeps the reactive force constant by adjusting an internal pressure of the air chamber of the second cylinder.

4. The closing device according to claim 2, wherein the reactive force maintaining mechanism comprises:

an air pressure supply source which supplies compressed air to the air chamber of the second cylinder through an air supply pipe; and a pressure regulator which reduces a pressure of the compressed air supplied by the air pressure supply source to maintain the pressure of an air system at a predetermined pressure, and maintains the predetermined pressure by discharging the compressed air when the pressure of the air chamber rises to or above the predetermined pressure.

* * * * *